US009163632B2

(12) United States Patent
Katou et al.

(10) Patent No.: US 9,163,632 B2
(45) Date of Patent: Oct. 20, 2015

(54) INJECTION PORT AND ORBITING-SIDE WRAP FOR A SCROLL COMPRESSOR

(71) Applicant: DAIKIN INDUSTRIES, LTD., Osaka-shi, Osaka (JP)

(72) Inventors: Katsumi Katou, Sakai (JP); Satoru Sakae, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 14 days.

(21) Appl. No.: 14/345,557

(22) PCT Filed: Sep. 20, 2012

(86) PCT No.: PCT/JP2012/005986

§ 371 (c)(1),
(2) Date: Mar. 18, 2014

(87) PCT Pub. No.: WO2013/042368

PCT Pub. Date: Mar. 28, 2013

(65) Prior Publication Data

US 2015/0004040 A1 Jan. 1, 2015

(30) Foreign Application Priority Data

Sep. 21, 2011 (JP) ..... 2011-206133

(51) Int. Cl.
*F03C 2/00* (2006.01)
*F03C 4/00* (2006.01)
(Continued)

(52) U.S. Cl.
CPC ..... *F04C 18/0215* (2013.01); *F04C 18/0261* (2013.01); *F04C 18/0269* (2013.01); *F04C 28/26* (2013.01); *F04C 29/0014* (2013.01); *F04C 2250/20* (2013.01)

(58) Field of Classification Search
CPC ..... F04C 18/0215; F04C 18/0261; F04C 18/0269; F04C 23/008; F04C 29/0007; F04C 29/0014; F04C 29/042; F01C 1/0215; F01C 1/0261
USPC ..... 418/15, 55.1–55.6, 57, 270; 417/310, 417/440
See application file for complete search history.

(56) References Cited

U.S. PATENT DOCUMENTS 4,676,075 A * 6/1987 Shiibayashi ..... 418/55.6
5,938,417 A * 8/1999 Takao et al. ..... 418/55.2

(Continued)

FOREIGN PATENT DOCUMENTS

JP 63-243481 A 10/1988
JP 11-107945 A 4/1999
JP 2000-64971 A 3/2000

OTHER PUBLICATIONS

International Search Report of corresponding PCT Application No. PCT/JP2012/005986, dated on Dec. 18, 2012.

(Continued)

*Primary Examiner* — Theresa Trieu
(74) *Attorney, Agent, or Firm* — Global IP Counselors

(57) ABSTRACT

A scroll compressor includes a compression mechanism having fixed and orbiting scrolls engaged with each other to form a compression chamber. Each of the fixed and orbiting scrolls includes an end plate and a spiral wall-shaped wrap extending from the end plate. The fixed scroll has an injection port configured to communicate with the compression chamber through a communication passageway located in the fixed-side end plate. The orbiting-side wrap has a thick portion located at a position corresponding to the injection port and having an increasing tooth thickness portion. A tooth thickness of the increasing tooth thickness portion increases from a start of winding to an end of winding of the orbiting-side wrap. The thick portion has a thickness greater than or equal to a dimension of an opening of the injection port measured along a tooth thickness of the orbiting-side wrap.

6 Claims, 5 Drawing Sheets

(51) Int. Cl.

| | |
|---|---|
| ***F04C 2/00*** | (2006.01) |
| ***F04C 18/02*** | (2006.01) |
| ***F04C 28/26*** | (2006.01) |
| ***F04C 29/00*** | (2006.01) |

(56) References Cited

U.S. PATENT DOCUMENTS

| | | | | |
|---|---|---|---|---|
| 6,089,839 | A | 7/2000 | Bush et al. | |
| 6,196,816 | B1 | 3/2001 | Lifson et al. | |
| 6,619,936 | B2 | 9/2003 | Perevozchikov | |
| 7,228,710 | B2 * | 6/2007 | Lifson | 418/55.2 |
| 7,278,832 | B2 * | 10/2007 | Lifson et al. | 418/55.1 |
| 7,338,264 | B2 * | 3/2008 | Lifson | 418/55.2 |
| 2010/0129240 | A1 * | 5/2010 | Shiibayashi et al. | 418/55.2 |
| 2012/0294748 | A1 * | 11/2012 | Shiibayashi et al. | 418/55.1 |

OTHER PUBLICATIONS

International Preliminary Report of corresponding PCT Application No. PCT/JP2012/005986, dated on Dec. 6, 2012.

* cited by examiner

INJECTION PORT AND ORBITING-SIDE WRAP FOR A SCROLL COMPRESSOR

CROSS-REFERENCE TO RELATED APPLICATIONS

This U.S. National stage application claims priority under 35 U.S.C. §119(a) to Japanese Patent Application No. 2011-206133, filed in Japan on Sep. 21, 2011, the entire contents of which are hereby incorporated herein by reference.

TECHNICAL FIELD

The present invention relates to scroll compressors including intermediate injection mechanisms, and particularly to a structure for increasing an injection flow rate.

BACKGROUND ART

A typical scroll compressor includes a compression mechanism and a drive mechanism in a casing. The compression mechanism includes a fixed scroll and an orbiting scroll. These scrolls include opposed end plates and spiral wraps that are integrally formed with the end plates and are engaged with each other.

In the compression mechanism of the scroll compressor, a wrap of the fixed scroll (hereinafter referred to as a fixed-side wrap) and a wrap of the orbiting scroll (hereinafter referred to as an orbiting-side wrap) are engaged with each other, thereby forming a compression chamber between the fixed scroll and the orbiting scroll. The orbiting scroll is coupled to a crankpin of a crank shaft (a driving shaft) of the drive mechanism. Rotation of the crank shaft causes the orbiting scroll to orbit around the fixed scroll, and accordingly, the volume of the compression chamber repeatedly increases and decreases. The compression mechanism sucks refrigerant when the volume of the compression chamber increases, and compresses refrigerant and discharges the compressed refrigerant when the volume of the compression chamber decreases.

On the other hand, some scroll compressors include injection mechanisms for injecting intermediate-pressure refrigerant to compression mechanisms (see, for example Japanese Unexamined Patent Publication No. H11-107945). A compression mechanism described in Patent Document 1 includes an injection port that axially penetrates an end plate of a fixed scroll and is open to an intermediate-pressure position of the compression chamber. The injection port is located at a center of a groove formed between spiral turns of a fixed-side wrap and has a diameter smaller than the thickness of an orbiting-side wrap.

In this configuration, the injection port alternately communicates with a first compression chamber formed between the inner peripheral surface of the fixed-side wrap and the outer peripheral surface of the orbiting-side wrap and a second compression chamber formed between the outer peripheral surface of the fixed-side wrap and the inner peripheral surface of the orbiting-side wrap. Specifically, with orbiting of an orbiting scroll, the orbiting-side wrap reciprocates between the inner peripheral surface and the outer peripheral surface of the fixed-side wrap across the injection port. In this reciprocation, the injection port communicates with the first compression chamber when the orbiting-side wrap is located between the injection port and the outer peripheral surface of the fixed-side wrap, whereas the injection port communicates with the second compression chamber when the orbiting-side wrap is located between the injection port and the inner peripheral surface of the fixed-side wrap.

Other compression mechanisms are configured to increase injection flow rates for higher performance (see, for example, U.S. Pat. No. 6,619,936 and Japanese Unexamined Patent Publication No. S63-243481). In each of the compression mechanisms of U.S. Pat. No. 6,619,936 and Japanese Unexamined Patent Publication No. S63-243481, a fixed scroll has an injection port whose diameter is greater than the tooth thickness of an orbiting-side wrap in order to increase the injection flow rate.

SUMMARY

Technical Problem

In a configuration in which the diameter of the injection port is larger than the thickness of the orbiting-side wrap as described in Patent Documents 2 and 3, however, the injection port communicates with both the first compression chamber and the second compression chamber at the same time through the orbiting-side wrap in operation of the compression mechanism. Communication between the first compression chamber and the second compression chamber causes leakage of refrigerant between the first compression chamber and the second compression chamber having different pressures, resulting in degradation of efficiency of the compressor.

In a configuration with an increased diameter of the injection port, if the thickness of the orbiting-side wrap is also increased to prevent communication between the first compression chamber and the second compression chamber, the increased thickness of the orbiting-side wrap increases the mass of the orbiting scroll, resulting in increases in size and cost of the compression mechanism.

It is therefore an object of the present invention to provide a scroll compressor for intermediate injection with an increased injection flow rate, reduced degradation of efficiency of the compressor, and reduced increases in size and cost of a compression mechanism.

Solution to the Problem

In a first aspect of the present invention, a scroll compressor includes: a compression mechanism (30) including a fixed scroll (50) including a fixed-side end plate (51) and a spiral wall-shaped fixed-side wrap (52) standing on the fixed-side end plate (51) and an orbiting scroll (40) including an orbiting-side end plate (41) and a spiral wall-shaped orbiting-side wrap (42) standing on the orbiting-side end plate (41), wherein the fixed-side wrap (52) and the orbiting-side wrap (42) are engaged with each other and form a compression chamber (35*a*, 35*b*) between the scrolls (40, 50), and the fixed scroll (50) has an injection port (55) that is configured to communicate with the compression chamber (35*a*, 35*b*) through a communication passageway located in the fixed-side end plate (51).

In this scroll compressor, the orbiting-side wrap (42) has a thick portion (45) including an increasing tooth thickness portion (45*a*) and located at a position corresponding to the injection port (55), a tooth thickness of the increasing tooth thickness portion (45*a*) increases from a start of winding to an end of winding of the orbiting-side wrap (42), and the thick portion (45) has a thickness greater than or equal to a dimension of an opening of the injection port (55) measured along a tooth thickness of the orbiting-side wrap (42). The dimension of the opening is a diameter when the injection port (55) has a circular shape, and is a width when the injection port (55) has an oval shape, for example.

In the first aspect, with orbiting of the orbiting scroll (40), the injection port (55) alternately communicates with a first compression chamber (35*a*, 35*b*) formed between the inner peripheral surface of the fixed-side wrap (52) and the outer peripheral surface of the orbiting-side wrap (42) and a second compression chamber (35*a*, 35*b*) formed between the outer peripheral surface of the fixed-side wrap (52) and the inner peripheral surface of the orbiting-side wrap (42). That is, when the orbiting scroll (40) orbits, the orbiting-side wrap (42) reciprocates between the inner peripheral surface and the outer peripheral surface of the fixed-side wrap (52) across the injection port (55). In this reciprocation, the injection port (55) communicates with the first compression chamber (35*a*, 35*b*) when the orbiting-side wrap (42) is located between the injection port (55) and the inner peripheral surface of the fixed-side wrap (52), whereas the injection port (55) communicates with the second compression chamber (35*a*, 35*b*) when the orbiting-side wrap (42) is located between the injection port (55) and the outer peripheral surface of the fixed-side wrap (52). When the injection port (55) communicates with the first compression chamber (35*a*, 35*b*), intermediate-pressure refrigerant flows into the first compression chamber (35*a*. 35*b*), whereas when the injection port (55) communicates with the second compression chamber (35*a*, 35*b*), intermediate-pressure refrigerant flows into the second compression chamber (35*a*, 35*b*).

Since the orbiting-side wrap (42) has the thick portion (45) whose thickness is greater than or equal to the dimension of the opening of the injection port (55), when the orbiting-side wrap (42) moves across the injection port (55), the injection port (55) is covered with the thick portion (45). In this manner, the entire injection port (55) is covered with the orbiting-side wrap (42), and thus, the injection port (55) does not communicate with the first compression chamber (35*a*, 35*b*) and the second compression chamber (35*a*, 35*b*) at the same time in this aspect.

In a second aspect of the present invention, in the scroll compressor of the first aspect, the thick portion (45) of the orbiting-side wrap (42) includes a decreasing tooth thickness portion (45*b*) whose tooth thickness decreases from a side close to the increasing tooth thickness portion (45*a*) to the end of winding of the orbiting-side wrap (42).

In the second aspect, a portion of the thick portion (45) of the orbiting-side wrap (42) within the range from the increasing tooth thickness portion (45*a*) to the decreasing tooth thickness portion (45*b*) is used for opening and closing the injection port (55).

In a third aspect of the present invention, in the scroll compressor of the second aspect, the thick portion (45) of the orbiting-side wrap (42) includes a continuous portion (45*c*) that is continuous to the increasing tooth thickness portion (45*a*) and the decreasing tooth thickness portion (45*b*) between the increasing tooth thickness portion (45*a*) and the decreasing tooth thickness portion (45*b*). The continuous portion (45*c*) may have a uniform tooth thickness, or may have a gently varying tooth thickness between the increasing tooth thickness portion (45*a*) and the decreasing tooth thickness portion (45*b*).

In the third aspect, a portion of the thick portion (45) of the orbiting-side wrap (42) ranging from the increasing tooth thickness portion (45*a*) to the decreasing tooth thickness portion (45*b*) via the continuous portion (45*c*) is used to open and close the injection port (55).

In a fourth aspect of the present invention, in the scroll compressor of the first, second, or third aspect, the thick portion (45) of the orbiting-side wrap (42) is a portion of an outer peripheral surface of the orbiting-side wrap (42) that protrudes radially outward relative to a spiral shape of an inner peripheral surface of the orbiting-side wrap (42), and the fixed-side wrap (52) has a recessed portion (57) that corresponds to the thick portion (45) of the orbiting-side wrap (42) and is recessed radially outward from an inner peripheral surface of the fixed-side wrap (52) in accordance with the thick portion (45).

In the first, second, and third aspects, the thick portion (45) can be formed by protruding the inner peripheral surface of the orbiting-side wrap (42) or protruding both the inner peripheral surface and the outer peripheral surface of the orbiting-side wrap (42). On the other hand, in the fourth aspect, the thick portion (45) is formed by protruding the outer peripheral surface of the orbiting-side wrap (42), and the recessed portion (57) is formed in the inner peripheral surface of the fixed-side wrap (52) and corresponds to the thick portion (45).

In the fourth aspect, with orbiting of the orbiting scroll (40), the surface of the thick portion (45) of the orbiting-side wrap (42) moves along the surface of the recessed portion (57) of the fixed-side wrap (52). Since the thick portion (45) corresponds to the recessed portion (57), neither failure in operation nor leakage of refrigerant occurs between the thick portion (45) and the recessed portion (57) in orbiting of the orbiting scroll (40).

In a fifth aspect of the present invention, in the scroll compressor of any one of the first through fourth aspects, the injection port (55) is located such that the injection port (55) communicates with the compression chamber (35*a*, 35*b*) immediately after a suction port of the compression chamber (35*a*, 35*b*) has been completely closed in operation of the compression mechanism (30).

In the fifth aspect, the injection port (55) can be located closer to the end of winding than the start of winding of the orbiting-side wrap (42). Thus, the thick portion (45) of the orbiting-side wrap (42) is also located close to the end of winding, and the recessed portion (57) of the fixed-side wrap (52) is also located close to the end of winding.

In a sixth aspect of the present invention, in the scroll compressor of any one of the first through fifth aspects, the compression mechanism (30) has an asymmetric spiral structure in which the fixed-side wrap (52) has a spiral length different from that of the orbiting-side wrap (42), and the injection port (55) is located at a center portion of a spiral groove formed by the fixed-side wrap (52).

In a symmetric spiral structure, two suction openings would be provided at the ends of winding of the orbiting-side wrap (42) and the fixed-side wrap (52) and the compression chamber (35*a*, 35*b*) would also have a symmetric structure. Thus, two injection ports (55) would be provided near the fixed-side wrap (52). On the other hand, since the sixth aspect employs the asymmetric spiral structure, one suction opening is provided at the ends of winding of the orbiting-side wrap (42) and the fixed-side wrap (52), and one injection port (55) is sufficient.

In the asymmetric spiral structure, one injection port (55) is formed at the center portion of the spiral groove of the fixed-side wrap (52), and is shared by the first compression chamber (35*a*, 35*b*) and the second compression chamber (35*a*, 35*b*). As a result, the range of angle in which the injection port (55) is open to each of the compression chambers (35*a*, 35*b*) is smaller than in a case where two injection ports (55) are provided near the fixed-side wrap (52). Consequently, when the injection port (55) is closed when the injection port (55) alternately communicates with the first compression chamber (35*a*, 35*b*) and the second compression chamber (35*a*, 35*b*), a pressure rise due to a change in volume of the compression chamber (35*a*, 35*b*) is small.

Advantages of the Invention

In the present invention, the thick portion (45) including the increasing tooth thickness portion (45*a*) whose tooth thickness increases from the start of winding to the end of winding is located at a portion of the orbiting-side wrap (42) corresponding to the injection port (55), and the thick portion (45) has a thickness greater than or equal to the dimension of the opening of the injection port (55). Thus, even when the injection port (55) is enlarged, the entire injection port (55) can be covered with the orbiting-side wrap (42) when the injection port (55) is closed.

Accordingly, the first compression chamber (35*a*, 35*b*) and the second compression chamber (35*a*, 35*b*) do not communicate with each other, and thus, leakage of refrigerant between the first compression chamber (35*a*, 35*b*) and the second compression chamber (35*a*, 35*b*) can be reduced even with an increased dimension of the opening of the injection port (55), thereby reducing degradation of efficiency of the compressor. In addition, the dimension of the opening of the injection port (55) can be increased, thus enabling an increased injection flow rate. Further, the thick portion (45) only needs to be provided in part of the orbiting-side wrap (42), and thus, an increase in mass of the orbiting scroll (40) can be reduced. As a result, increases in size and cost of the mechanism can be reduced.

In the second and third aspects, the thick portion (45) of the orbiting-side wrap (42) is formed within the range from the increasing tooth thickness portion (45*a*) to the decreasing tooth thickness portion (45*b*). Thus, both a portion closer to the start of winding of the orbiting-side wrap (42) than the increasing tooth thickness portion (45*a*) and a portion closer to the end of winding of the orbiting-side wrap (42) than the decreasing tooth thickness portion (45*b*) can be made thinner than the thick portion (45). This configuration further ensures reduction of an increase in mass of the orbiting scroll (40).

In the fourth aspect, the thick portion (45) of the orbiting-side wrap (42) is located at the outer side of the orbiting-side wrap (42), and the recessed portion (57) of the fixed-side wrap (52) is located at the inner side of the fixed-side wrap (52) and corresponds to the thick portion (45). Thus, in orbiting of the orbiting scroll (40), neither failure in operation nor leakage of refrigerant occurs between the thick portion (45) and the recessed portion (57). In addition, since protrusion of the outer side of the orbiting-side wrap (42) and recessing of the inner side of the fixed-side wrap (52) can be easily performed, complexity in fabrication can be reduced.

In the fifth aspect, the injection port (55) can be located closer to the end of winding than the start of winding of the orbiting-side wrap (42). Thus, the thick portion (45) of the orbiting-side wrap (42) and the recessed portion (57) of the fixed-side wrap (52) can also be located close to the end of winding. Further, the thick portion (45) and the recessed portion (57) can be more easily processed at the end of winding than at the start of winding, thereby easing fabrication.

In the sixth aspect, the compression mechanism (30) has the asymmetric spiral structure, and the injection port (55) is located at the center portion of the spiral groove of the fixed-side wrap (52). Thus, one injection port (55) is shared by the first compression chamber (35*a*, 35*b*) and the second compression chamber (35*a*, 35*b*). If the injection port (55) for the first compression chamber (35*a*, 35*b*) and the injection port (55) for the second compression chamber (35*a*, 35*b*) were individually provided, the port would be located near the wrap, and thus, the injection ports (55) would be open to each of the compression chambers (35*a*, 35*b*) in a wider range of angle. On the other hand, the single injection port (55) can reduce the range of angle in which the injection port (55) is open to each of the compression chambers (35*a*, 35*b*). Consequently, the injection port (55) can be closed with a small rise in pressure due to a change in volume of the compression chambers (35*a*, 35*b*), thereby reducing a rise in intermediate pressure. As a result, degradation of efficiency of the compressor can be reduced.

In particular, since the injection port (55) is located such that the injection port (55) communicates with the compression chamber (35*a*, 35*b*) immediately after the suction port thereof has been completely closed in operation of the compression mechanism (30), the thick portion (45) of the orbiting-side wrap (42) and the recessed portion (57) of the fixed-side wrap (52) can also be located at the outermost side of each wrap. Thus, this configuration can be easily applied to an asymmetric spiral structure having a conventional shape.

BRIEF DESCRIPTION OF THE DRAWINGS

FIG. 4A illustrates a state in which the crank angle is 0° (360°), FIG. 4B illustrates a state in which the crank angle is 90°, FIG. 4C illustrates a state in which the crank angle is 180°, and FIG. 4D illustrates a state in which the crank angle is 270°.

DESCRIPTION OF EMBODIMENTS

An embodiment of the present invention will be described with reference to the drawings.

Figure 1:
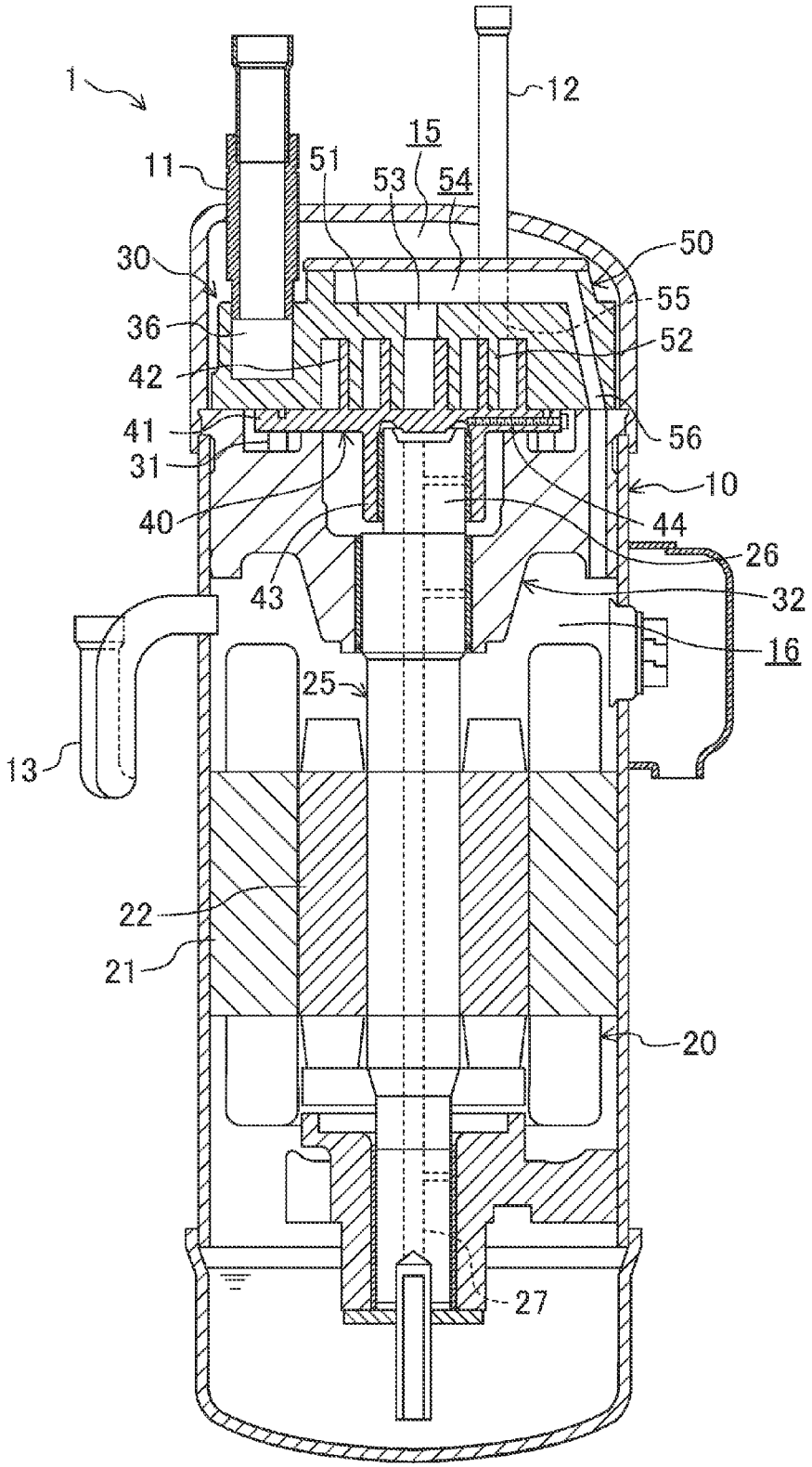
FIG. 1 is a vertical sectional view of a scroll compressor according to an embodiment of the present invention.
Figure 2:
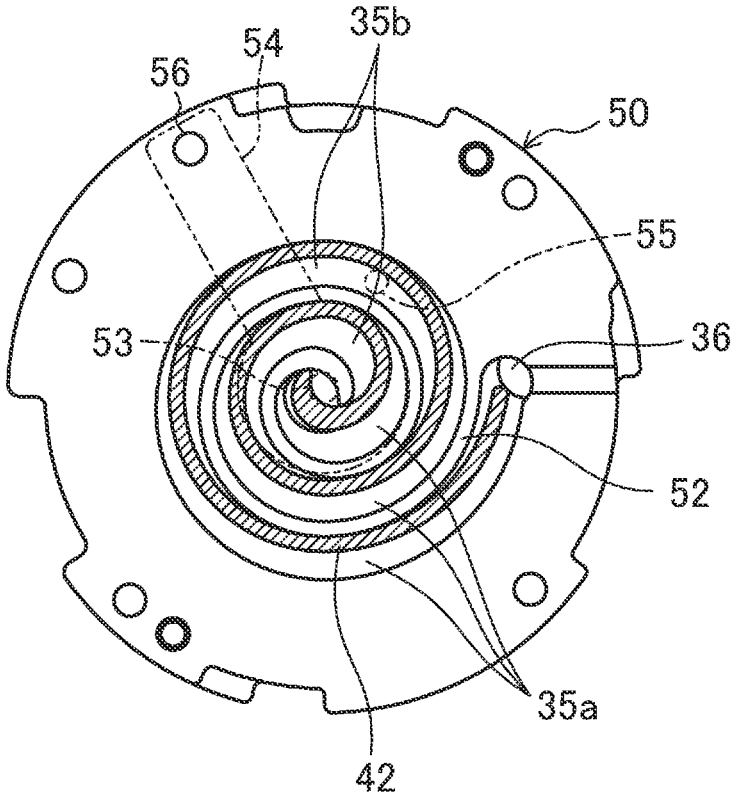
FIG. 2 is a bottom view of a fixed scroll in which a fixed-side wrap and an orbiting-side wrap are engaged with each other.

A scroll compressor (1) according to this embodiment is configured to perform a compression stroke of a refrigerant circuit (not shown) for a vapor compression refrigeration cycle, compresses low-pressure refrigerant sucked from an evaporator to high-pressure refrigerant, and discharges the refrigerant to a condenser (a heat dissipater). FIG. 1 is a vertical sectional view of the scroll compressor (1). FIG. 2 illustrates a configuration of a compression mechanism.

The scroll compressor (1) includes a casing (10) in the shape of an elongated closed container. In the casing (10), an electric motor (20) and a compression mechanism (30) are disposed from the bottom to the top. The electric motor (20) includes a stator (21) fixed to the body of the casing (10) and a rotor (22) located inside the stator (21). A crank shaft (25) is coupled to the rotor (22).

A compression mechanism (30) includes an orbiting scroll (40) and a fixed scroll (50). The orbiting scroll (40) includes an approximately circular plate-like orbiting-side end plate (41) and a spiral-wall shaped orbiting-side wrap (42) standing on the orbiting-side end plate (41). A cylindrical projection (43) into which an eccentric portion (26) of the crank shaft (25) is inserted projects from the back surface (the lower surface) of the orbiting-side end plate (41). The orbiting scroll (40) is supported on a housing (32) below the orbiting scroll (40) through an Oldham coupling (31). On the other hand, the fixed scroll (50) includes an approximately circular plate-like fixed-side end plate (51) and a spiral wall-shaped fixed-side wrap (52) standing on the fixed-side end plate (51). In the compression mechanism (30), the fixed-side wrap (52) and the orbiting-side wrap (42) are engaged with each other, thereby forming a plurality of compression chambers (35) between contact portions of these wraps (42, 52).

The scroll compressor (1) of this embodiment employs a so-called asymmetric spiral structure in which the number of turns (i.e., the length of spiral) differs between the fixed-side wrap (52) and the orbiting-side wrap (42). The compression chambers (35) are constituted by a first compression chamber (35*a*) formed between the inner peripheral surface of the fixed-side wrap (52) and the outer peripheral surface of the orbiting-side wrap (42) and a second compression chamber (35*b*) formed between the outer peripheral surface of the fixed-side wrap (52) and the inner peripheral surface of the orbiting-side wrap (42).

In the compression mechanism (30), a suction port (36) is formed in the outer rim of the fixed scroll (50). In this embodiment employing the asymmetric spiral structure, the single suction port (36) communicates with both the first compression chamber (35*a*) and the second compression chamber (35*b*). The suction port (36) is connected to a suction pipe (11). The suction port (36) intermittently communicates with each of the first compression chamber (35*a*) and the second compression chamber (35*b*) in accordance with revolution of the orbiting scroll (40). The suction port (36) has a suction check valve (not shown) that prevents refrigerant from flowing from the compression chambers (35) back to the suction pipe (11).

In the compression mechanism (30), a discharge port (53) is formed in a center portion of the fixed-side end plate (51). The discharge port (53) intermittently communicates with each of the first compression chamber (35*a*) and the second compression chamber (35*b*) with revolution of the orbiting scroll (40). The discharge port (53) is open to a muffler space (54) in an upper portion of the fixed scroll (50).

The casing (10) is divided by the disc-shaped housing (32) into an upper suction-side space (15) and a lower discharge-side space (16). The discharge-side space (16) communicates with the muffler space (54) through a communication passage (56). During operation, since refrigerant discharged from the discharge port (53) flows into the discharge-side space (16) through the muffler space (54), the discharge-side space (16) becomes a high-pressure space filled with refrigerant compressed in the compression mechanism (30). A discharge pipe (13) fixed to the casing (10) is open to the discharge-side space (16).

An oil sump for storing refrigerating machine oil is provided at the bottom of the casing (10). In the crank shaft (25), a first oil supply passage (27) that is open to the oil sump is formed. In the orbiting-side end plate (41), a second oil supply passage (44) connected to the first oil supply passage (27) is formed. In the scroll compressor (1), refrigerating machine oil in the oil sump is supplied to the compression chambers (35) at the low pressure side through the first oil supply passage (27) and the second oil supply passage (44).

Then, a configuration for injecting intermediate-pressure refrigerant to the compression chambers (35*a*, 35*b*) in the compression mechanism (30) will be described.

The fixed scroll (50) has an injection port (55) that communicates with the compression chambers (35) through a communication passageway formed in the fixed-side end plate (51). The injection port (55) is connected to the injection pipe (12). The injection pipe (12) is fixed to the fixed-side end plate (51).

Figure 3A:
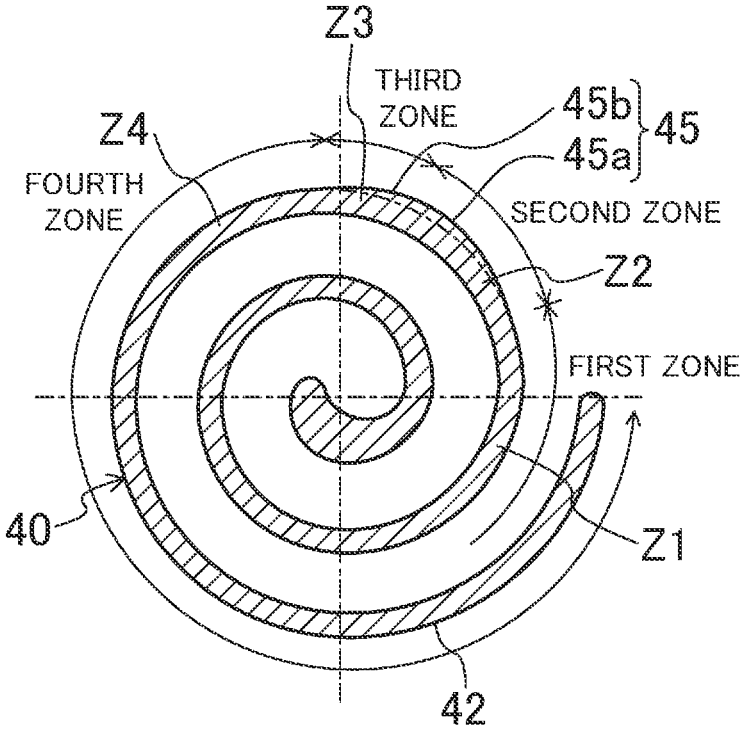
FIG. 3A is a sectional view illustrating a spiral shape of the orbiting-side wrap.
Figure 3B:
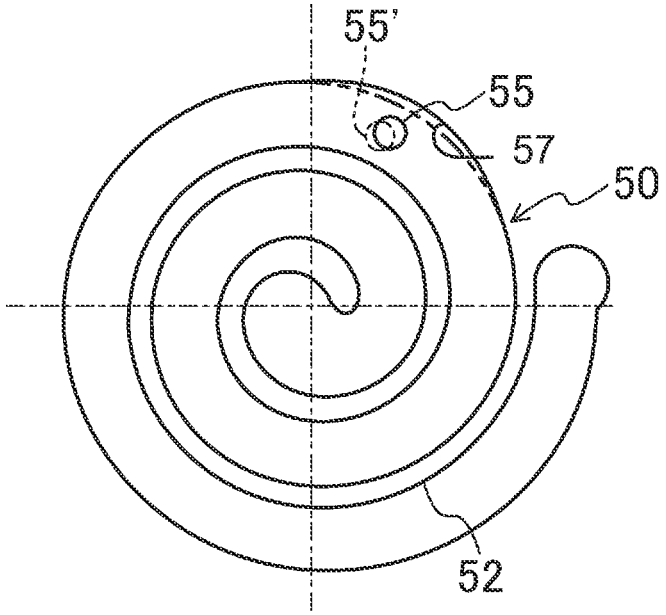
FIG. 3B is a bottom view of a spiral shape of the fixed-side wrap.

The injection port (55) is located at a position at which the injection port (55) communicates with the compression chamber (35*a*, 35*b*) immediately after the suction port thereof has been completely closed in operation of the compression mechanism (30). The injection port (55) communicates with the first compression chamber (35*a*) or the second compression chamber (35*b*) immediately after the suction port has been completely closed after termination of suction of refrigerant into the compression chamber (35*a*, 35*b*). Specifically, in the wrap shape illustrated in FIG. 3A, suppose the spiral orbiting-side wrap (42) is divided into a first zone (Z1), a second zone (Z2), a third zone (Z3), and a fourth zone (Z4) arranged from the start of winding (i.e., from the center) to the end of winding (i.e., to the outside), the position of the injection port (55) in the fixed scroll (50) corresponds to the boundary between the second zone (Z2) and the third zone (Z3) (see FIG. 3B). In this embodiment, one injection port (55) is provided, and this injection port (55) is formed in the center portion of the spiral groove of the fixed-side wrap (52).

Here, in a typical scroll compressor, the tooth thickness of an orbiting-side wrap is uniform from the start of winding to the end of winding. As another example, in some scroll compressors, the tooth thickness of the orbiting-side wrap decreases at a constant rate from the start of winding to the end of winding. In general, a fixed-side wrap and an orbiting-side wrap of a scroll compressor are formed as an involute curve. If the tooth thickness is uniform from the start of winding to the end of winding, the base circle radius of the involute is uniform and does not vary in the entire wraps. If the tooth thickness decreases at a constant rate from the start of winding to the end of winding, the base circle radius of the involute decreases from the start of winding to the end of winding in the wraps.

In this embodiment, the tooth thickness of the orbiting-side wrap (42) is uniform between the first zone (Z1) and the fourth zone (Z4), increases toward the end of winding in the second zone (Z2), and decreases toward the end of winding in the third zone (Z3). In this configuration, the base circle radius of the involute is the same in the first zone (Z1) and the fourth zone (Z4), the base circle radius of the involute in the second zone (Z2) is larger than that in the first zone (Z1) and the fourth zone (Z4), and the base circle radius of the involute in the third zone (Z3) is smaller than that in the first zone (Z1) and the fourth zone (Z4). The base circle center of the involute in the second zone (Z2) and the third zone (Z3) may coincide with the base circle center of the involute in the first zone (Z1) and the fourth zone (Z4) or may be different from the base circle center of the involute in the first zone (Z1) and the fourth zone (Z4). The shape of a typical orbiting-side wrap having a uniform tooth thickness from the start of winding to the end of winding is indicated as a virtual line in FIG. 3A.

The injection port (55) is a circular hole whose diameter is slightly larger than the tooth thickness of the first zone (Z1) and the fourth zone (Z4) of the orbiting-side wrap (42). For comparison, in FIG. 3B, an injection port (55') that can be blocked with a typical orbiting-side wrap with a uniform tooth thickness is indicated by a virtual line. In the orbiting-side wrap (42) of this embodiment, the thickness of the second zone (Z2) and the third zone (Z3) is greater than or equal to the diameter of the injection port (55), and the injection port (55) whose diameter is larger than the tooth thickness of the wrap in the first zone (Z1) and the fourth zone (Z4) can be blocked in the range from the second zone (Z2) to the third zone (Z3).

Specifically, the orbiting-side wrap (42) has, at a position corresponding to the injection port (55), a thick portion (45) including an increasing tooth thickness portion (45*a*) whose tooth thickness increases from the start of winding to the end of winding of the orbiting-side wrap (42). The thick portion (45) includes a decreasing tooth thickness portion (45*b*) whose tooth thickness decreases from the increasing tooth thickness portion (45*a*) to the end of winding of the orbiting-side wrap (42). The increasing tooth thickness portion (45*a*) is formed in the second zone (Z2) of the orbiting-side wrap. The decreasing tooth thickness portion (45*b*) is formed in the third zone (Z3) of the orbiting-side wrap. The tooth thickness of the thick portion (45) is greater than or equal to the diameter of the injection port (55).

The thick portion (45) of the orbiting-side wrap (42) is formed by protruding the outer peripheral surface (the outer flank) relative to the spiral shape of the inner peripheral surface of orbiting-side wrap (42). On the other hand, the fixed-side wrap (52) includes a recessed portion (57) that corresponds to the thick portion (45) of the orbiting-side wrap (42) and is recessed radially outward from the inner peripheral surface (the inner flank) of the fixed-side wrap (52).

—Operation—

In this embodiment, as illustrated in FIGS. 4A-4D in which orbiting of the orbiting scroll (40) is illustrated for each 90°, with orbiting of the orbiting scroll (40), the injection port (55) alternately communicates with the first compression chamber (35*a*) formed between the inner peripheral surface of the fixed-side wrap (52) and the outer peripheral surface of the orbiting-side wrap (42) and the second compression chamber (35*b*) formed between the outer peripheral surface of the fixed-side wrap (52) and the inner peripheral surface of the orbiting-side wrap (42).

Specifically, the orbiting scroll (40) orbits in the order of FIGS. 4A, 4B, 4C, and 4D, and the orbiting-side wrap (42) reciprocates while orbiting between the inner peripheral surface and the outer peripheral surface of the fixed-side wrap (52). In this reciprocation, the orbiting-side wrap (42) moves across the injection port (55) radially from the outside to the inside, or radially from the inside to the outside.

When the orbiting-side wrap (42) is located between the injection port (55) and the outer peripheral surface of the fixed-side wrap (52) (see FIG. 4B), the injection port (55) communicates with the first compression chamber (35*a*). When the orbiting-side wrap (42) is located between the injection port (55) and the inner peripheral surface of the fixed-side wrap (52) (see FIG. 4D), the injection port (55) communicates with the second compression chamber (35*b*). When the injection port (55) communicates with the first compression chamber (35*a*), intermediate-pressure refrigerant flows into the first compression chamber (35*a*). When the injection port (55) communicates with the second compression chamber (35*b*), intermediate-pressure refrigerant flows into the second compression chamber (35*b*).

Figure 4A:
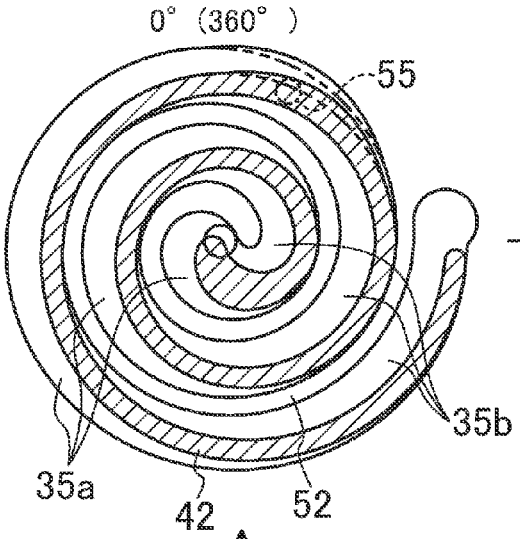
FIGS. 4A through 4D are sectional views illustrating operation states of a compression mechanism.
Figure 4B:
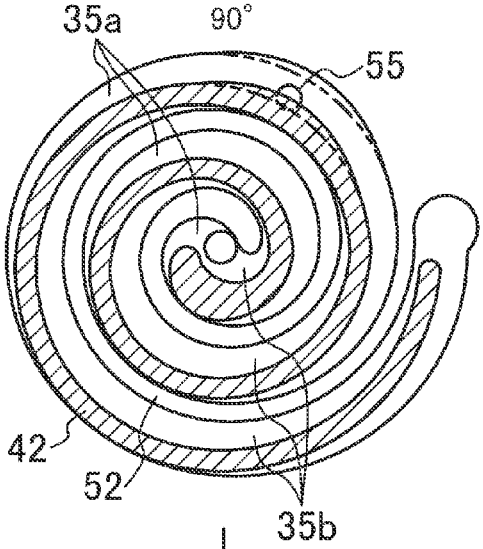
Figure 4D:
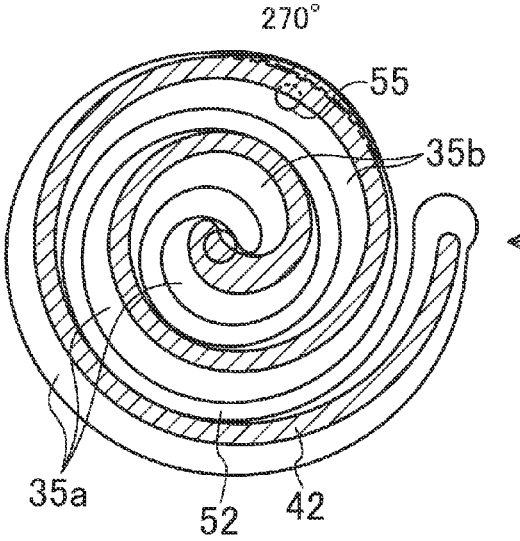
Figure 4C:
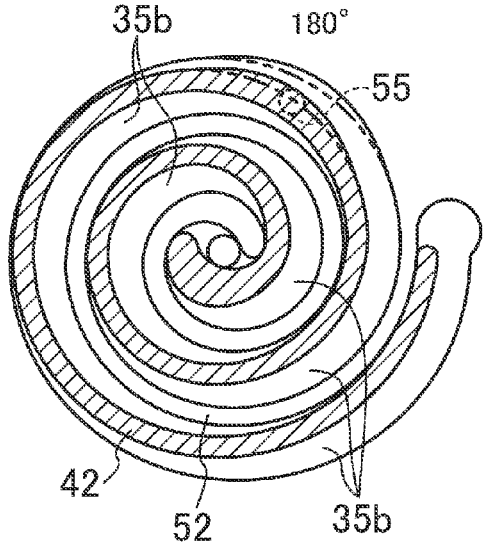

Since the orbiting-side wrap (42) has the thick portion (45) whose thickness is greater than or equal to the diameter of the injection port (55), the injection port (55) is blocked with the thick portion (45) when the orbiting-side wrap (42) moves across the injection port (55) (FIGS. 4A and 4C). In this manner, the entire injection port (55) is covered with the orbiting-side wrap (42), the first compression chamber (35*a*) and the second compression chamber (35*b*) do not communicate with the injection port (55) at the same time in this embodiment.

The thick portion (45) can be formed by protruding the inner peripheral surface or both of the inner peripheral surface and the outer peripheral surface of the orbiting-side wrap (42). In this embodiment, the thick portion (45) is formed by protruding the outer peripheral surface of the orbiting-side wrap (42) and the recessed portion (57) corresponding to the thick portion (45) is formed in the fixed-side wrap (52). In this manner, with orbiting of the orbiting scroll (40), the surface of the thick portion (45) at the outer side of the orbiting-side wrap (42) moves along the surface of the recessed portion (57) at the inner side of the fixed-side wrap (52). Since the thick portion (45) corresponds to the recessed portion (57), neither failure in operation nor leakage of refrigerant does not occur between the thick portion (45) and the recessed portion (57) in orbiting of the orbiting scroll (40).

In addition, in this embodiment, the injection port (55) is located closer to the end of winding than the start of winding of the orbiting-side wrap (42) so that the injection port (55) communicates with the compression chamber (35*a*, 35*b*) immediately after the suction port thereof has been completely closed. Thus, the thick portion (45) of the orbiting-side wrap (42) is located close to the end of winding, and the recessed portion (57) of the fixed-side wrap (52) are also located close to the end of winding. In this manner, the injection port (55) is opened or closed at a position close to the end of winding of the wrap (42, 52) in orbiting of the orbiting scroll (40).

A symmetric spiral structure has two suction openings at the ends of winding of the orbiting-side wrap (42) and the fixed-side wrap (52), and the compression chamber, which also has a symmetric structure, has two injection ports (55) in general. On the other hand, this embodiment employs the asymmetric spiral structure having one suction opening at the ends of winding of the orbiting-side wrap (42) and the fixed-side wrap (52), and thus, has one injection port (55).

In addition, the asymmetric spiral structure has one injection port (55) formed in a center portion of the spiral groove of the fixed-side wrap (52), and thus, the injection port (55) is shared by the first compression chamber (35*a*) and the second compression chamber (35*b*). As a result, the range of angle in which the injection port (55) is open to each compression chamber is smaller than in the structure including two injection ports (55). Consequently, when the injection port (55) is closed while the injection port (55) alternately communicates with the first compression chamber (35*a*) and the second compression chamber (35*b*), a pressure rise due to a change in volume of the compression chamber is small. In addition, since the injection port (55) is formed in a low-pressure portion at the end of winding of the orbiting-side wrap (42) as described above, the injection port (55) is completely closed quickly accordingly, thereby reducing a rise of an intermediate pressure.

Advantages of Embodiment

In this embodiment, the thick portion (45) including the increasing tooth thickness portion (45*a*) whose tooth thickness increases from the start of winding to the end of winding of the orbiting-side wrap (42) is formed at a position of the orbiting-side wrap (42) corresponding to the injection port (55). The thickness of the thick portion (45) is greater than or equal to the diameter of the injection port (55). Thus, even when the injection port (55) is enlarged as in this embodiment, the entire injection port (55) is covered with the orbiting-side wrap (42) when the injection port (55) is closed.

Accordingly, the first compression chamber (35*a*) does not communicate with the second compression chamber (35*b*) during orbiting of the orbiting scroll (40), leakage of refrigerant between the first compression chamber (35*a*) and the second compression chamber (35*b*) can be prevented even with the injection port (55) having an increased diameter, thereby reducing degradation of efficiency of the compressor (1). In addition, since the diameter of the injection port (55) can be increased, the injection flow rate can be increased. Further, it is sufficient to provide the thick portion (45) only in part of the orbiting-side wrap (42), and thus, an increase in mass of the orbiting scroll (40) is smaller than that in a case where the tooth thickness of the entire orbiting-side wrap (42) is increased. Accordingly, increases in size and cost of the mechanism can be reduced.

Moreover, since the thick portion (45) of the orbiting-side wrap (42) is located within the range from the increasing tooth thickness portion (45*a*) to the decreasing tooth thickness portion (45*b*), both of a portion closer to the start of winding of the orbiting-side wrap (42) than the increasing tooth thickness portion (45*a*) and a portion closer to the end of winding of the orbiting-side wrap (42) than the decreasing tooth thickness portion (45*b*) can be made thinner than the thick portion (45). This configuration can further ensure reduction of an increase in mass of the orbiting scroll (40).

In the above configuration, the compression mechanism has the asymmetric spiral structure and the injection port (55) is located at the center portion of the spiral groove of the fixed-side wrap (52). Thus, the mechanism has one injection port (55), which is shared by the first compression chamber (35*a*) and the second compression chamber (35*b*). If the injection port (55) for the first compression chamber (35*a*) and the injection port (55) for the second compression chamber (35*b*) were individually provided, the injection ports (55) would be open to each of the compression chambers (35*a*, 35*b*) in a wider range of angle. On the other hand, the single injection port (55) can reduce the range of angle in which the injection port (55) is open to each of the compression chambers (35*a*, 35*b*). Consequently, the injection port (55) can be closed with a small rise in pressure due to a change in volume of the compression chambers (35*a*, 35*b*), thereby reducing a rise in intermediate pressure. As a result, degradation of efficiency of the compressor can be reduced.

In particular, since the injection port (55) is located such that the injection port (55) communicates with the compression chamber immediately after the suction port thereof has been completely closed in operation of the compression mechanism (30), the thick portion (45) of the orbiting-side wrap (42) and the recessed portion (57) of the fixed-side wrap (52) can also be located at the outermost side of each wrap. Thus, this configuration can be easily applied to an asymmetric spiral structure having a conventional shape.

In addition, the thick portion (45) of the orbiting-side wrap (42) is located at the outer side of the orbiting-side wrap (42), and the recessed portion (57) of the fixed-side wrap (52) is located at the inner side of the fixed-side wrap (52) such that the recessed portion (57) corresponds to the thick portion (45). Thus, neither failure in operation nor leakage of refrigerant does not occur between the thick portion (45) and the recessed portion (57) during orbiting of the orbiting scroll (40).

Further, since the injection port (55) can be located at a position closer to the end of winding than the start of winding of the orbiting-side wrap (42), the thick portion (45) of the orbiting-side wrap (42) and the recessed portion (57) of the fixed-side wrap (52) can also be located at positions close to the end of winding. Thus, the thick portion (45) and the recessed portion (57) can be more easily processed than in a case where the thick portion (45) and the recessed portion (57) are located close to the start of winding. As a result, fabrication can be easily performed.

Furthermore, since the process of protruding the outer side and the orbiting-side wrap (42) and the process of recessing the inner side of the fixed-side wrap (52) can be easily performed, these processes contribute to reduction of complicated fabrication. In this manner, control of the base circle radius of the involute for increasing the tooth thickness can be applied only to the outermost periphery of each of the inner flank of the fixed scroll (50) and the outer flank of the orbiting scroll (40). Thus, this control can be relatively easily applied to a conventional spiral structure (i.e., an asymmetric spiral structure). For example, in some cases, only a change in spiral shape is sufficient without an increase in the end plate diameter of the spiral. Further, in application of the structure of the present invention to a conventional asymmetric spiral shape, the barycenter of the spiral is located close to the center of the spiral, and thus, the weight necessary for balancing the orbiting scroll (40) can be reduced.

Other Embodiments

The foregoing embodiment may have the following configurations.

For example, in the above embodiment, the tooth thicknesses of the second zone (Z2) and the third zone (Z3) of the orbiting-side wrap (42) are larger than that of the first zone (Z1) and the fourth zone (Z4) in order to form the thick portion (45). Alternatively, the third zone (Z3) and the fourth zone (Z4) may have a thickness equal to the thickness of the second zone (Z2) at the end of winding such that the tooth thickness of the fourth zone (Z4) is larger than that of the first zone (Z1). In another possible configuration, the first zone (Z1) and the second zone (Z2) of the orbiting-side wrap (42) may be formed as one zone such that the tooth thickness gradually increases, and the third zone (Z3) and the fourth zone (Z4) are the same as those illustrated in FIG. 3A. In these configurations, an enlargement of the injection port (55) can increase the injection flow rate, and the entire injection port (55) can be covered with the thick portion (45) of the orbiting-side wrap (42). Thus, no leakage of refrigerant occur from the first compression chamber (35*a*) to the second compression chamber (35*b*). In addition, since it is unnecessary to increase the tooth thickness of the entire orbiting-side wrap (42), increases in size and cost can be reduced. That is, the thick portion (45) of the present invention may have any shape as long as the injection port (55) can be enlarged without an increase in tooth thickness of the entire orbiting-side wrap (42).

The injection port (55) does not need to be located at a position at which the injection port (55) communicates with the compression chamber immediately after the suction port thereof has been completely closed. In some cases, the injection port (55) may be located closer to the inner periphery of the spiral than the position illustrated in FIG. 3B.

Figure 5:
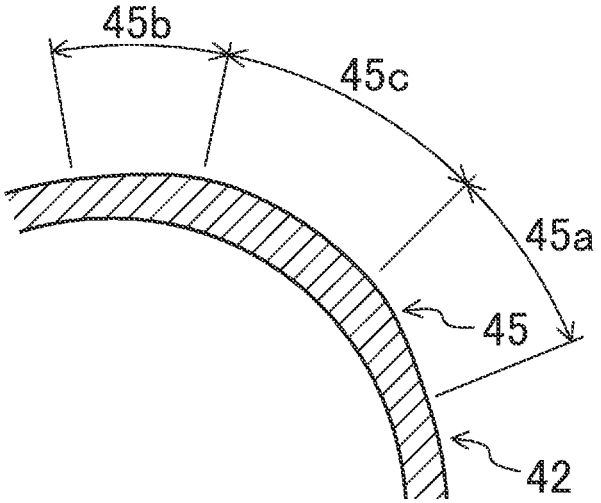
FIG. 5 is a partially enlarged view illustrating a variation of a thick portion of the orbiting-side wrap.

As illustrated in a variation of FIG. 5, the thick portion (45) of the orbiting-side wrap (42) may include a continuous portion (45*c*) that is continuous to the increasing tooth thickness portion (45*a*) and the decreasing tooth thickness portion (45*b*) between the increasing tooth thickness portion (45*a*) and the decreasing tooth thickness portion (45*b*). In a configuration in which the end portion at the end of winding of the increasing tooth thickness portion (45*a*) has a thickness equal to that of the end portion at the start of winding of the decreasing tooth thickness portion (45*b*), the tooth thickness of the continuous portion (45*c*) is uniform. On the other hand, in a configuration in which the end portion at the end of winding of the increasing tooth thickness portion (45*a*) has a thickness slightly different from that of the end portion at the start of winding of the decreasing tooth thickness portion (45*b*), the continuous portion (45*c*) may have a tooth thickness that varies slightly.

Figure 6:
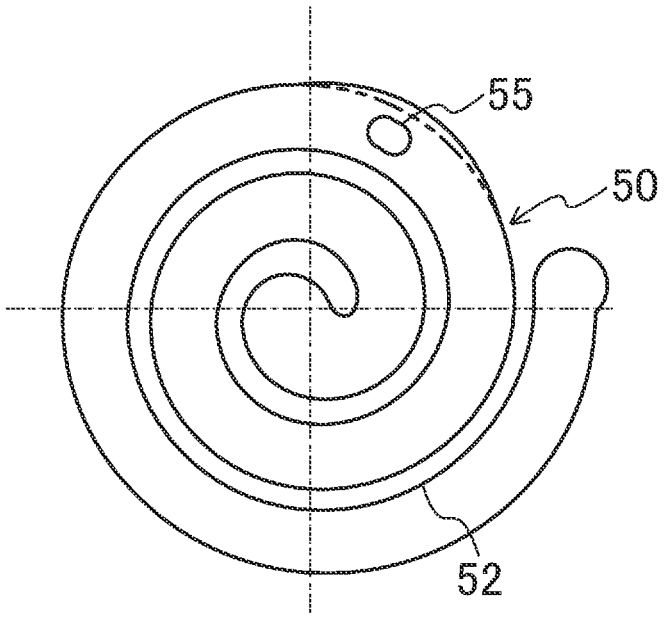
FIG. 6 is a view illustrating a variation of an injection port.

In the embodiment, the injection port (55) has a circular shape. Alternatively, as illustrated in a variation of FIG. 6, the injection port (55) may have an oval shape. In this manner, the shape of the injection port (55) is not limited to the example described in the embodiment, and may be appropriately changed as long as the tooth thickness of the thick portion (45) is greater than or equal to the diameter of the opening of the injection port (55) in the tooth thickness direction (i.e., the diameter of the circular hole in the above embodiment).

In addition, in the above embodiment, the present invention is applied to the scroll compressor with the asymmetric spiral structure. The present invention is also applicable to a scroll compressor with a symmetric spiral structure.

The foregoing embodiments are merely preferred examples in nature, and are not intended to limit the scope, applications, and use of the invention.

INDUSTRIAL APPLICABILITY

As described above, the present invention is useful for scroll compressors having intermediate injection mechanisms.

1 scroll compressor
30 compression mechanism
35*a* first compression chamber
35*b* second compression chamber
40 orbiting scroll
41 orbiting-side end plate
42 orbiting-side wrap
45 thick portion
45*a* increasing tooth thickness portion
45*b* decreasing tooth thickness portion
50 fixed scroll
51 fixed-side end plate
52 fixed-side wrap
55 injection port
57 recessed portion

The invention claimed is:

1. A scroll compressor comprising:

a compression mechanism including a fixed scroll including a fixed-side end plate and a spiral wall-shaped fixed-side wrap extending from the fixed-side end plate, and an orbiting scroll including an orbiting-side end plate and a spiral wall-shaped orbiting-side wrap extending from the orbiting-side end plate, the fixed-side wrap and the orbiting-side wrap being engaged with each other to form a compression chamber between the fixed and orbiting scrolls, the fixed scroll having an injection port configured to communicate with the compression chamber through a communication passageway located in the fixed-side end plate, the orbiting-side wrap having a thick portion thicker than an adjacent portion, the thick portion having an increasing tooth thickness portion, and the thick portion being located at a position corresponding to the injection port, a tooth thickness of the increasing tooth thickness portion increasing from a start of winding to an end of winding of the orbiting-side wrap, and the thick portion having a thickness greater than or equal to a dimension of an opening of the injection port measured along a tooth thickness of the orbiting-side wrap.

2. The scroll compressor of claim 1, wherein the thick portion of the orbiting-side wrap includes a decreasing tooth thickness portion with a tooth thickness decreasing from the increasing tooth thickness portion toward the end of winding of the orbiting-side wrap.

3. The scroll compressor of claim 2, wherein the thick portion of the orbiting-side wrap includes a continuous portion that is continuous with and disposed between the increasing tooth thickness portion and the decreasing tooth thickness portion.

4. The scroll compressor of claim 1, wherein the thick portion of the orbiting-side wrap is a portion of an outer peripheral surface of the orbiting-side wrap that protrudes radially outward relative to a spiral shape of an inner peripheral surface of the orbiting-side wrap, and the fixed-side wrap has a recessed portion that corresponds to the thick portion of the orbiting-side wrap and is recessed radially outward from an inner peripheral surface of the fixed-side wrap in accordance with the thick portion protruding radially outward.

5. The scroll compressor of claim 1, wherein the injection port is located such that the injection port communicates with the compression chamber immediately after a suction port of the compression chamber has been completely closed during operation of the compression mechanism.

6. The scroll compressor of claim 1, wherein the compression mechanism has an asymmetric spiral structure in which the fixed-side wrap has a spiral length different from a spiral length of the orbiting-side wrap, and the injection port is located at a center portion of a spiral groove defined by the fixed-side wrap.

* * * * *